US005673678A

United States Patent [19]

Savage

[11] Patent Number: 5,673,678

[45] Date of Patent: Oct. 7, 1997

[54] ARROW REST FOR ARCHERY BOW

[76] Inventor: Huey P. Savage, 110 N. Front St., Oak Grove, La. 71263-1589

[21] Appl. No.: 650,459

[22] Filed: May 20, 1996

[51] Int. Cl.[6] ..... F41B 5/00

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 3,935,854 | 2/1976 | Troncoso, Jr. | 124/44.5 X |
| 4,332,232 | 6/1982 | Troncoso, Jr. | 124/44.5 X |
| 4,686,956 | 8/1987 | Troncoso, Jr. | 124/44.5 |
| 4,838,237 | 6/1989 | Cliburn | 124/44.5 |
| 5,052,364 | 10/1991 | Martin et al. | 124/44.5 |
| 5,070,855 | 12/1991 | Troncoso | 124/44.5 |
| 5,400,763 | 3/1995 | Mazza | 124/44.5 |
| 5,429,107 | 7/1995 | Troncoso, Jr. | 124/24.1 X |

FOREIGN PATENT DOCUMENTS

| | | | |
|---|---|---|---|
| 2597968 | 10/1987 | France | 124/24.1 |

OTHER PUBLICATIONS

Catalog pp. 30 and 31 showing examples of Known Arrow Rests. "Golden Futura" (Date unknown).

*Primary Examiner*—Randolph A. Reese

*Assistant Examiner*—Thomas A. Beach

*Attorney, Agent, or Firm*—Roy A. Ekstrand

[57] ABSTRACT

A pair of arrow rest prongs are supported beneath an arrow by a bracket secured to an archery bow. The prongs are supported in a mirror arrangement and define corresponding mirror image structures. Each arrow rest prong includes an attachment pin of generally cylindrical shape and defining a head portion to which a multiply curved multiply angled Teflon prong portion is attached by direct molding. Each prong defines an end proximate to the cylindrical pin and receiving the head portion from which the molded portion of the prong curves outwardly to an outwardly angled portion and transitions to an inwardly angled portion which in turn transitions to a rest end which defines a downwardly and outwardly curved portion. A curved crown is formed at the uppermost portion of the rest end. The prongs are identical in structure and shape with the difference being a mirror image relationship between the prongs. The resulting structure facilitates substantial tolerance to the angular position of an arrow vane supported by the arrow rest due to the outwardly angled and inwardly angled portions of the prongs.

12 Claims, 3 Drawing Sheets

ARROW REST FOR ARCHERY BOW

FIELD OF THE INVENTION

This invention relates generally to archery apparatus and particularly to retracting arrow rests for use on archery bows intended to avoid or minimize contact between the arrow rest and the vanes of the arrow.

BACKGROUND OF THE INVENTION

The sport of archery has enjoyed ever increasing popularity among a wide group of enthusiasts. The apparatus used in both target shooting and hunting has evolved to a considerable level of sophistication. To increase the power and accuracy of archery apparatus, practitioners in the art have developed compound bows which impart extraordinary energy to the arrows which they shoot. In a typical compound bow, an elongated rigid riser defines a hand grip and supports a pair of extending flexible limbs on either end. Each limb supports a rotatable eccentric wheel or cam to which a pair of cables and a bow string are secured. An arrow rest is supported upon the riser in some fashion to support the forward portion of the arrow shaft as the bow is drawn and aimed.

Arrows themselves have enjoyed considerable development and have evolved from simple wooden shaft implements with feather fletchings and fixed arrow heads or points to modern high strength lightweight arrows using hollow aluminum alloy shafts or composite materials which support threaded inserts and removable interchangeable points or heads. The traditional feather fletchings have generally been replaced by plastic fletchings or vanes and the arrow nock is typically formed of a high strength molded material such as plastic or the like.

Perhaps the most pervasive type of arrow rest used in modern archery involves a pair of spaced prongs which are supported by a shaft or bracket which in turn is secured to the bow riser or arrow guard in some fashion. .Typically, the prongs have inwardly curved ends upon which the arrow shaft rests. To reduce friction, the prongs may be covered with a low friction material such as Teflon. Generally, the low friction material is formed as a tube which may be received upon the prong ends. The space between the prongs is intended to allow the arrow vane to pass as the arrow is launched.

When an archer fits an arrow to the bow, the nock is fitted to the bow string at a point referred to as the nocking point and the front portion of the arrow is rested within the arrow rest. The arrow and bow string are then drawn back flexing the limbs and rotating the eccentric wheels to store energy in the bow. Once the bow is drawn, the nocking point on the bow string and the arrow rest define an axis often referred to as the shooting axis along which the arrow is launched when the bow string of the drawn bow is released. As the arrow is accelerated from the bow, the vanes often contact or brush the arrow rest causing an unpredictable and undesirable deflection of the arrow which degrades the accuracy of the archer.

One of the primary reasons for undesired contact between arrow vanes and the arrow rest is errors in the rotational orientation of the arrow vanes. For example, the angular relationship between the arrow vanes and the nock are themselves subject to variation in the manufacturing process. Also, as the arrow is released, the arrow may rotate slightly. Furthermore, the size of the notch in the arrow nock is larger than the bowstring allowing angular "slop" which also affects the vane orientation.

In attempting to overcome the problems associated with arrow rest deflection through contact with the arrow vanes, practitioners in the art have developed various apparatus such as flexible or movable arrow rests intended to move from the arrow's path as the vanes contact the arrow rest. These are often complex and are subject to problems of timing and proper release action.

Another approach to the arrow rest vane contact deflection problem utilizes mechanisms which sense the shock to the bow when the bow string is released and are operative to respond by quickly moving the arrow rest to a retracted position. This type of mechanism, however, has been found unreliable due to an inability to accurately time the arrow rest retraction. In such devices, premature arrow rest retraction allows the arrow to drop during acceleration while late or slow arrow rest retraction permits the vanes to contact the arrow rest.

Thus, despite substantial improvement in the various arrow rest structures, problems of vane contact with the arrow rest are still troublesome. As a result, there remains therefore a continuing need in the art for an arrow rest for an archery bow which effectively and reliably supports the arrow prior to and during launch and which is structured to avoid undesired deflection of the arrow due to contact between the arrow rest and the vanes of the launched arrow.

SUMMARY OF THE INVENTION

Accordingly, it is a general object of the present invention to provide an improved arrow rest for archery bow. It is a more particular object of the present invention to provide an improved arrow rest for archery bow which is more tolerant of arrow vane position and alignment while simultaneously maintaining shooting accuracy.

In accordance with the invention, there is provided for use in supporting an arrow shaft in an archery bow, an arrow rest comprising: support means for attachment to an archery bow; a pair of mirror image arrow rests prongs each having an attachment pin defining a cylindrical end and a head end and a prong portion molded upon the head end which defines an outwardly angled portion, an inwardly angled portion, and rest end curving downwardly and outwardly to form a curved crown portion; and retainer means supported upon the support means for holding the pair of arrow rest prongs in an upwardly angled generally symmetrical mirror-image relationship.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
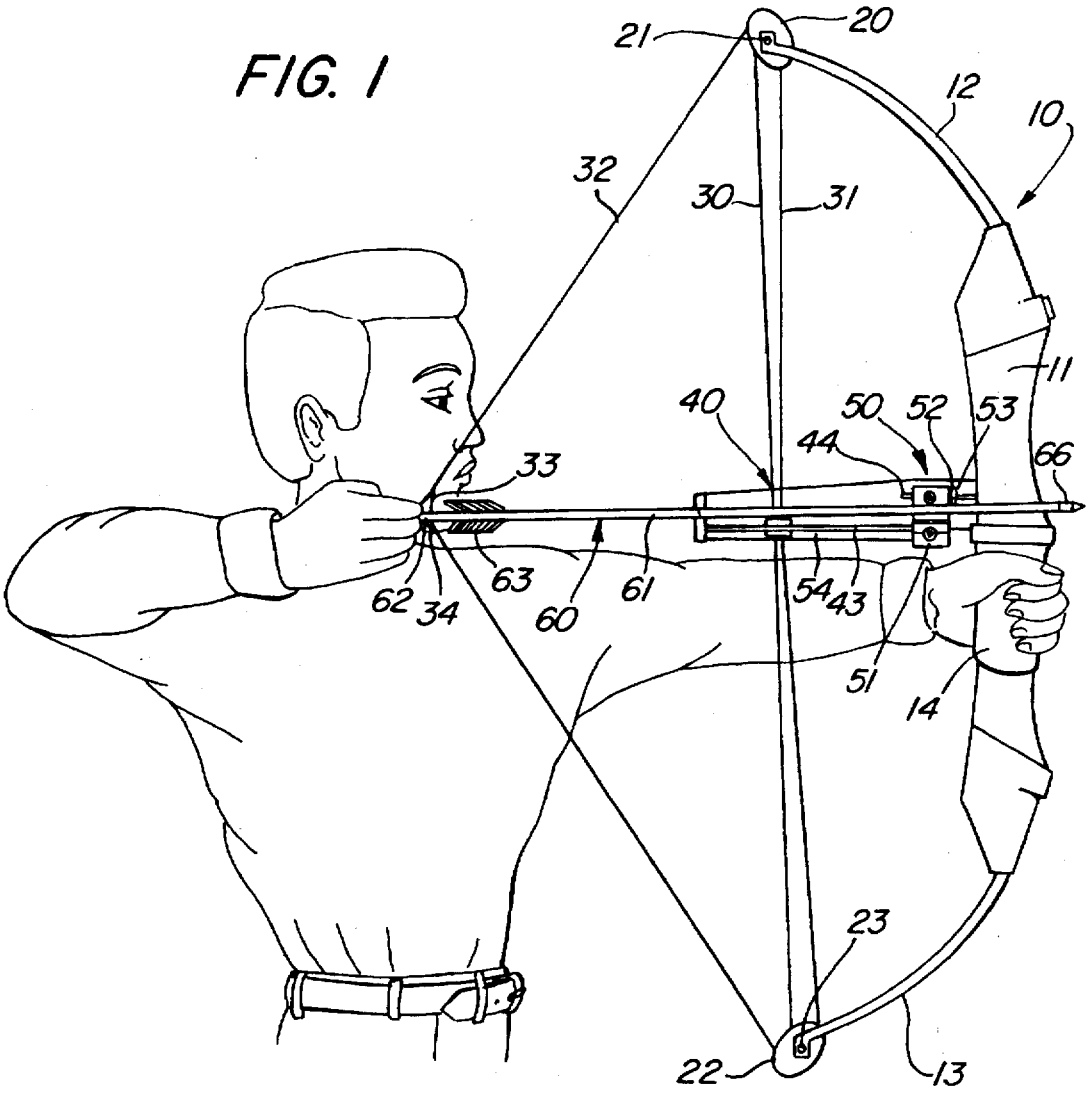
FIG. 1 sets forth a side view of a typical compound bow utilizing the present invention arrow rest in the drawn bow position.

FIG. 1 sets forth a side view of a compound bow generally referenced by numeral 10 having an arrow rest constructed in accordance with the present invention and generally referenced by numeral 50. Compound bow 10 includes an elongated generally rigid riser 11 defining a hand grip 14 and supporting a pair of extending flexible limbs 12 and 13. Limbs 12 and 13 rotatably support a pair of eccentric wheels or cams 20 and 22 through the attachment of a pair of shafts 21 and 23 respectively. In accordance with conventional fabrication techniques, compound bow 10 further includes a pair of flexible cables 30 and 31 coupled to eccentric wheels 20 and 22 in the conventional manner. A bow string 32 is secured between eccentric wheels 20 and 22 and defines a nocking point 33 and a flexible loop 34 extending on either side of nocking point 33.

Compound bow 10 further includes a cable guard 40 secured to riser 11 above grip 14 in accordance with conventional fabrication techniques and extending rearwardly therefrom. Cable guard 40 supports a horizontal shaft 43 and defines an elongated slot 44.

In accordance with the present invention, an arrow rest generally referenced by numeral 50 includes a generally L-shaped body 51 secured to cable guard 40. Arrow rest 50 includes a pair of prongs 52 and 53 supported by body 51 as set forth below. Prongs 52 and 53 converge to form a resting support region for arrow 60.

Finally, an arrow generally referenced by numeral 60 and constructed in accordance with conventional fabrication techniques includes an elongated shaft 61 having a point 66 at the forward end thereof and an arrow nock 62 at the rearward end thereof. Nock 62 is received upon and engages bow string 32 at nocking point 33. Arrow 60 further includes a plurality of conventional vanes 63 secured to shaft 61 forwardly of arrow nock 62.

In operation, the archer initially grasps grip 14 and while holding compound bow 10 secures nock 62 of arrow 60 to bow string 32 at nocking point 33 and thereafter rests shaft 61 of arrow 60 upon the arrow guide or rest provided by prongs 52 and 53. As is set forth below in greater detail, prongs 52 and 53 are generally converging to form a support beneath arrow shaft 61. The archer then grasps loop 62 and begins drawing bow string 32 and arrow 60 rearwardly storing energy in the bow as limbs 12 and 13 flex. Once bow 10 has been drawn to the desired position generally corresponding to that shown in FIG. 1, arrow shaft 61 rests upon prongs 52 and 53 and arrow 60 remains properly aligned. Thereafter, as the archer maintains the drawn position of bow 10, arrow 60 is securely supported and the archer is able to aim and target the desired object. As the archer releases loop 34 of bow string 32, the stored energy within limbs 12 and 13 is released and arrow 60 is accelerated forwardly along an axis known as the shooting axis defined between nocking point 33 and the resting position of arrow 60 within arrow guide 52.

As arrow 60 is accelerated, shaft 61 slides upon the upper end portions of prongs 52 and 53. In the preferred form of the invention described below, prongs 52 and 53 are formed in part of a low friction material such as sold under the trademark Teflon. As arrow 60 continues to be accelerated by the action of limbs of 12 and 13 acting through bow string 32, shaft 61 continues to slide upon prongs 52 and 53 and arrow 60 moves forwardly. As the end of the arrow launch draws near, vanes 63 of arrow 60 approach prongs 52 and 53. In accordance with an important aspect of the present invention, prongs 52 and 53 are formed of divergent portions, shown below to provide enhanced vane clearance such that vanes 63 do not contact arrow guide 50 as arrow 60 leaves bow 10. Thus, the above-described problems of arrow rest contact with the vanes of arrow 60 is avoided by the novel structure of arrow rest 50. Also, the low friction surfaces of prongs 52 and 53 sufficiently "slick" to minimize frictional contact with the arrow shaft as the arrow undergoes the normal flexing or arching in response to the bow string acceleration.

Figure 2:
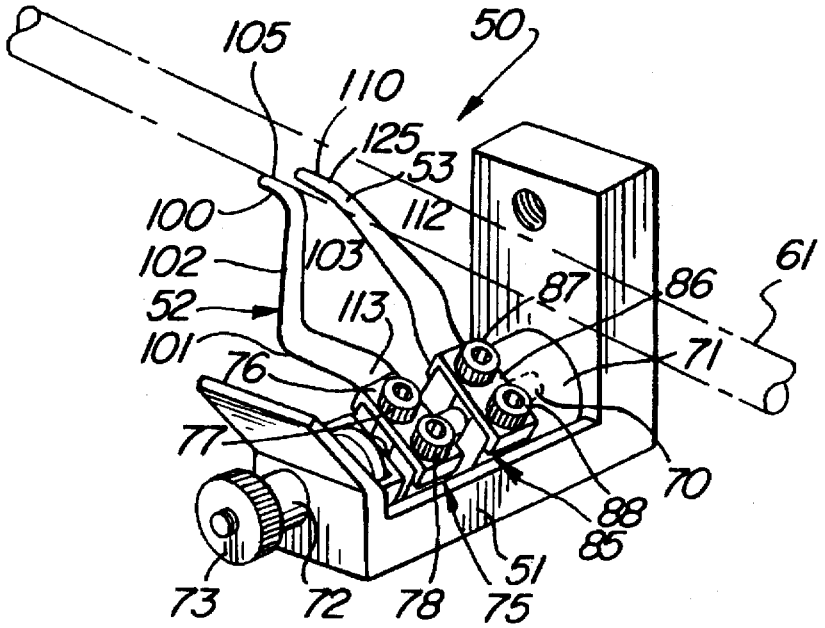
FIG. 2 sets forth a perspective assembly view of an arrow rest constructed in accordance with the present invention.

FIG. 2 sets forth a perspective view of an arrow rest constructed in accordance with the present invention and generally referenced by numeral 50. Arrow rest 50 includes a generally L-shaped body 51 configured for attachment to an archery bow apparatus such as cable guard 40 secured to riser 11 in the manner seen in FIG. 1. Alternatively, it will be apparent to those skilled in the art, however, that arrow rest 50 may be secured to a variety of differently configured bows and different apparatus supported thereon. Arrow rest 50 further includes an elongated shaft 70 supported at its interior end by a bearing 71 and at its outer end by a bearing 72. A threaded lock 73 is threadably received upon the outer end of shaft 70 and is utilized in securing the position of shaft 70 with respect to body 51. A pair of launcher retainers 75 and 85 comprise generally U-shaped members received upon shaft 70 and secured thereto by respective lock plates 76 and 86. Lock plate 76 is secured to launcher retainer 75 in the manner set forth below in FIG. 5 utilizing fasteners 77 and 78. Similarly, lock plate 86 is secured to launcher retainer 85 by fasteners 87 and 88.

In accordance with the present invention, arrow rest 50 further includes a pair of symmetrically arranged mirror image arrow rest prongs 52 and 53. As is set forth below in greater detail with particular attention to FIGS. 3 and 4, arrow rest prongs 52 and 53 are multiply curved and angled to provide an accurately positioned arrow rest portion at rest ends 100 and 110 while simultaneously providing an increased clearance region between prongs 52 and 53 which tolerates misalignment of an arrow vane thereby ensuring that undesired contact between the arrow vane and the arrow rest prongs is avoided. More specifically, arrow prong 52 is secured to launcher retainer 75 in the manner set forth below in FIG. 5 by virtue of a cylindrical pin 104 extending beyond lower end 103 of prong 52. Suffice it to note here that arrow rest prong 52 is firmly secured to launcher retainer 75. From end 103, arrow rest prong 52 curves outwardly and extends to an outwardly angled portion 101. From outwardly angled portion 101, arrow rest prong 52 then curves inwardly and transitions to an inwardly angled portion 102. Finally, at the uppermost end of arrow rest prong 52, a rest end 100 is formed which is curved outwardly and downwardly leaving a crowned portion 105 at the uppermost surface of arrow rest prong 52. In addition to the multiply curved multiply angled structure of arrow rest prong 52, the prong further is characterized by a generally circular cross section and an overall taper or reduction in circular diameter between end 103 and rest end 100.

Arrow rest prong 53 includes an identical attachment pin 114 (seen in FIG. 4) extending from end 113 thereof to be secured within launcher retainer 85. As mentioned, arrow rest prong 53 is a mirror image otherwise identical in fabrication of arrow rest prong 52. Thus, the two when arranged in the mirror image manner shown in FIG. 2, define a substantially symmetrical mirror image pair of arrow rest prongs with the symmetry thereof being in reference to both horizontal and vertical planes. Thus, arrow rest prong 53 includes lower end 113, an outwardly angled portion 111, an inwardly angled portion 112, an uppermost crowned portion 125 and an outwardly and downwardly curving rest end 110. For purposes of illustration, a typical arrow shaft 61 is shown in dashed line representation as it would rest upon crowned portions 105 and 125 of prongs 52 and 53 in a typical use. As is illustrated in FIG. 3, an arrow resting upon crowned portions 105 and 125 is positioned such that one vane of the arrow extends downwardly between the prongs.

In accordance with the present invention and as is shown below in greater detail, prongs 52 and 53 are preferably formed of a low friction molded material such as that manufactured and sold under the tradename Teflon. As is also set forth below and in further accordance with the present invention, the Teflon prong portions of arrow rest prongs 52 and 53 extend continuously from ends 103 and 113 to ends 100 and 110 respectively. It has been found advantageous to fabricate arrow rest prongs 52 and 53 by molding a suitably formed attachment pin such as attachment pins 104 and 114 shown in FIG. 4 directly into ends 103 and 113 of the arrow rest prongs. This fabrication provides a maximum of strength and produces the virtually universal mounting capability of the present invention arrow rest prongs. If necessary, differently sized and configured attachment pins may be molded into the arrow rest prongs to provide further capability for use in various types of arrow rest devices.

Figure 3:
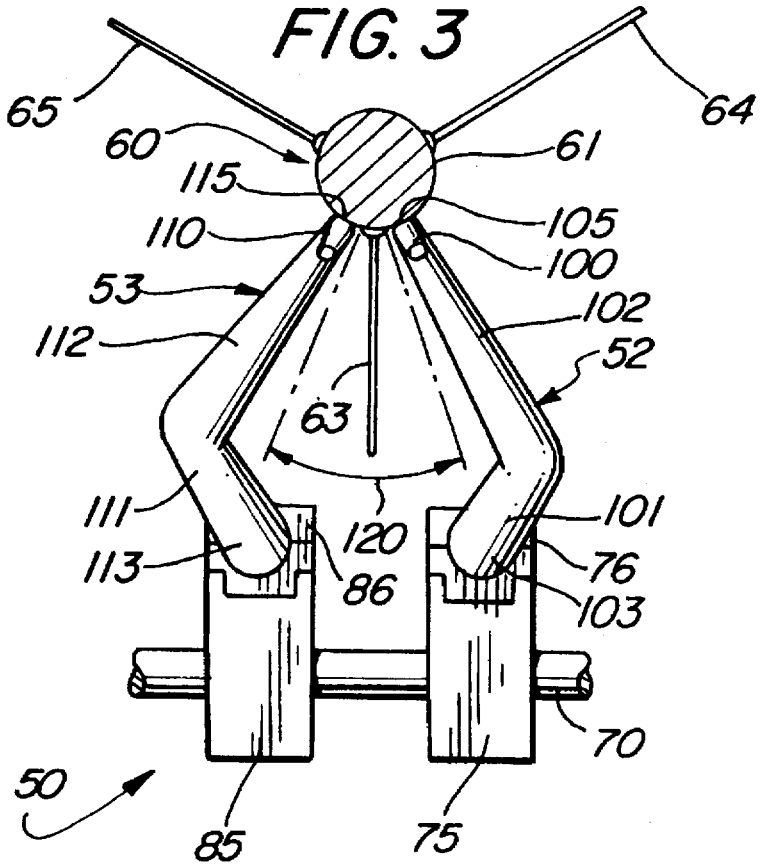
FIG. 3 sets forth a frontal view of the present invention arrow rest showing an arrow supported by the present invention arrow rest.

FIG. 3 sets forth a frontal view of the arrow rest prongs of the present invention and their respective supports upon the arrow rest shaft. Also shown in FIG. 3 is a section view of an arrow resting upon the arrow rest prongs in a typical resting position.

More specifically, arrow rest 50 includes a transversely extending shaft 70 having a pair of launcher retainers 75 and 85 supported thereon. Launcher retainer 75 includes a lock plate 76 which receives the attachment pin of arrow rest prong 52 in the manner described below to secure end 103 of prong 52 with respect to shaft 70. Similarly, launcher retainer 85 includes a lock plate 86 which secures an attachment pin in the manner described below for arrow rest prong 53. Once again, the essential aspect of launcher retainer 85 is to securely maintain end 113 of prong 53 with respect to shaft 70.

As described above and in accordance with an important aspect of the present invention, arrow rest prong 52 includes an outwardly angled portion 101 extending from end 103 which transitions to an inwardly angled portion 102. The latter terminates in a rest end 100 which curves downwardly and outwardly from a crown portion 105. As is also described above, prong 53 is a mirror image of prong 52 and thus includes an outwardly angled portion 111 extending from end 113 which transitions to an inwardly angled portion 112. Angled portion 112 transitions to a rest end 110 which is angled downwardly and outwardly forming a crown portion 115.

A conventional arrow 60 includes a cylindrical arrow shaft 61 supporting a plurality of vanes 63, 64 and 65. In the position shown in FIG. 3, shaft 61 rests upon prongs 52 and 53 contacting the prongs at crown portions 105 and 115. As mentioned above, prongs 52 and 53 are formed of a low friction material such as that sold under the tradename Teflon or the like. The essential feature of the material from which prongs 52 and 53 are molded is the provision of a low friction contact at crowns 105 and 115 which allows arrow shaft 61 to slight effortlessly upon the crown portions of the arrow prongs as the arrow is launched.

In accordance with an important aspect of the present invention, an angular tolerance indicated by angle 120 extending on each side of vane 63 defines an angular range within which vane 63 may be angularly displaced from the proper center line position shown without the occurrence of undesired contact between vane 63 and arrow rest prongs 52 and 53. Thus, in the event vane 63 is damaged or bent, it will nonetheless clear arrow rest 50 and particularly prongs 52 and 53 during launch due to this increased angular clearance. Similarly, a misalignment of arrow 60 which would otherwise cause vane 63 to be brought into contact with conventional arrow rest prongs will simply displace vane 63 without harmful contact. Thus, the integrity and accuracy of arrow launch is maintained by the structure and shape of arrow rest prongs 52 and 53.

Figure 4:
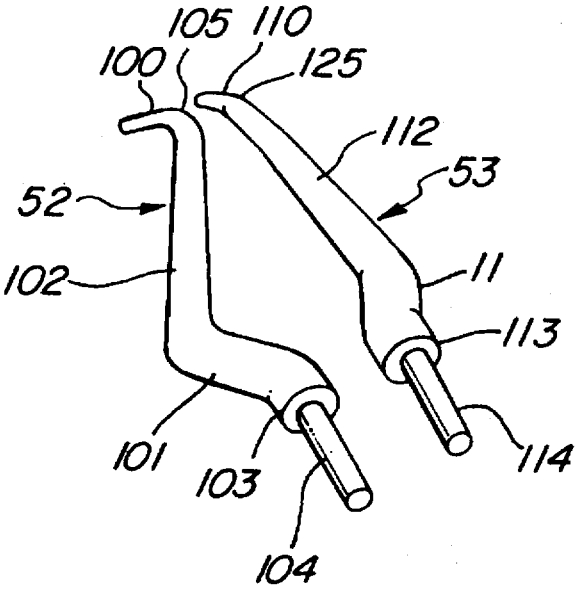
FIG. 4 sets forth a perspective view of the arrow rest prongs of the present invention arrow rest.

FIG. 4 sets forth a perspective view of arrow rest prongs 52 and 53 showing extending attachment pins 104 and 114. Thus, arrow rest 52 includes an elongated cylindrical attachment pin 104 to which a multiply curved and multiply angled molded prong portion is secured. By means set forth below in FIGS. 5 and 6, attachment pin 104 is molded into end 103 of prong 52. Similarly, attachment pin 114 is molded into the Teflon portion of prong 53 at end 113. The resulting set of arrow rest prongs shown in FIG. 4 provides a pair of mirror image prongs presenting a flexible resilient low friction prong set. The cylindrical shape of attachment pins 104 and 114 is provided to facilitate a virtually universal attachment of the present invention arrow rest prongs within various types of arrow rest apparatus. It will be apparent to those skilled in the art that other shapes of attachment pins may be provided to suit different requirements of arrow rests having different structural needs.

Figure 6:
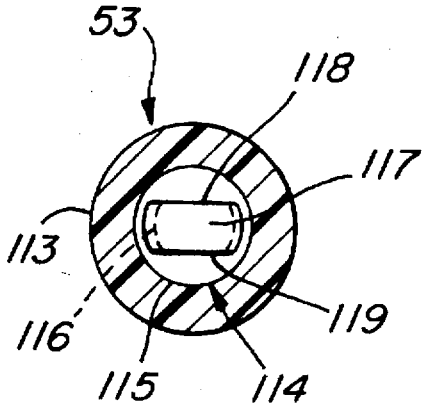
FIG. 6 sets forth a section view of the arrow rest prong of FIG. 5 taken along section lines 6—6 therein.
Figure 5:
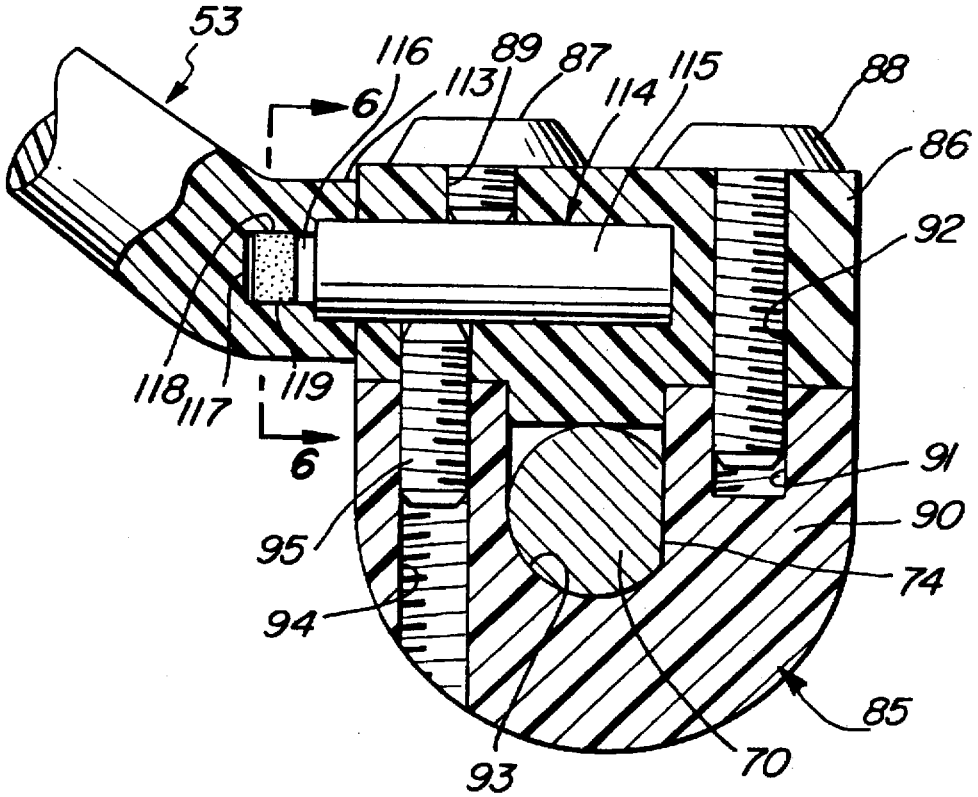
FIG. 5 sets forth a partial section view of an arrow rest prong of the present invention arrow rest.

FIG. 5 sets forth a partial section view of the attachment of arrow rest prong 53 to launcher retainer 85. Launcher retainer 85 includes a U-shaped clamp portion 90 defining a slot 93 which receives shaft 70. Shaft 70 defines a flat facet 74 which abuts the side portion of slot 93 to prevent rotational motion of shaft 70 with respect to launcher retainer 85. U-shaped clamp portion 190 further defines a threaded bore 91 and a threaded bore 94 on each side of slot 93. A lock plate 86 is received upon clamp portion 90 and defines a bore 92 axially aligned with bore 91 of clamp 90 and a bore 89. A transversely extending bore 96 is formed within lock plate 86 and is in communication with bores 89 and 94. Arrow rest prong 53 includes an end 113 within which a portion of attachment pin 114 is received and secured during the molding process. Attachment pin 114 defines a cylindrical end 115 received within bore 96 and extending from end 113. The remainder of attachment pin 114 extends into end 113 of prong 53 and defines a groove 116 of reduced diameter and a head portion 117. As is better seen in FIG. 6, head portion 117 defines a pair of oppositely positioned flats 118 and 119. Thus, head 117 is not actually cylindrical but rather is generally cylindrical with opposed flatted facets on opposite sides as shown in FIG. 6. This provision of flats 118 and 119 on head 117 has been found to more securely maintain the attachment of end 113 to attachment pin 114 with particular strength against rotational or torsional forces. Thus, during the molding process, the Teflon portion of arrow rest prong 53 is molded directly upon attachment pin 114 and flows about head 117 and groove 116 to securely anchor attachment pin 114.

Fastener 88 extends through lock plate 86 and threadably engages bore 91 of clamp 90 to secure lock plate 86 to clamp 90. Fastener 87 extends downwardly through bore 89 and is tightened against the underlying portion of cylindrical end 115 of attachment pin 114 to secure arrow rest prong 53 at the desired position. Similarly, set screw 95 is threaded through bore 94 and engages the underlying portion of cylindrical end 115 to further captivate and secure attachment pin 114.

It will be apparent to those skilled in the art that the present invention prongs may be secured to various arrow rest structures of the type known generally in the prior art. An example of such alternative attachment is shown in the partial section view of FIG. 7.

FIG. 6 sets forth a section view of arrow rest prong 53 taken along section lines 6—6 in FIG. 5. As can be seen, prong 53 includes a generally circular cross section end 113 within which cylindrical end 115 of attachment pin 114 is molded. As can also be seen, attachment pin 114 includes a head 117 having opposed cylindrical outer surfaces and opposed flat portions 118 and 119. Head 117 is enlarged with respect to a groove 116 which as is better seen in FIG. 5 is positioned between head 117 and the interior end of cylindrical end 115.

It will be understood by those skilled in the art that prong 52 is identical to prong 53 with the single difference being the mirror image shape thereof. Apart from this difference, however, it will be understood that prong 52 is fabricated in the identical manner as prong 53 as shown in FIGS. 5 and 6. In addition, it will be further understood that prong 52 is fabricated using the same fabrication process of molding in the interior end portion of attachment pin 104 in an identical structure to attachment pin 114 within prong 53.

Figure 7:
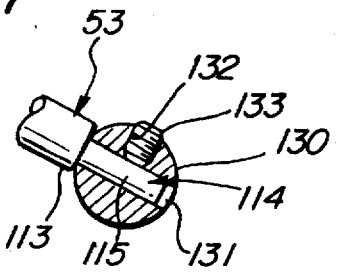
FIG. 7 is a partial view of an alternate embodiment of the present invention arrow rest.

FIG. 7 sets forth a partial section view of the present invention arrow rest prong utilized in a different prong support structure. The prong support structure shown in FIG. 7 utilizes a generally cylindrical shaft enlargement 130 to support a pair of arrow rest prongs 52 and 53 in a mirror image arrangement characterized by the drawing of FIG. 4. In essence, the embodiment of FIG. 7 utilizes a shaft similar to shaft 70 in the embodiment of FIG. 2 having an enlarged portion 130 in place of launcher retainers 75 and 85 in FIG. 2. Shaft enlargement 130 defines a bore 131 extending therethrough together with a perpendicularly extending threaded bore 132. Prong 53 is positioned with respect to shaft enlargement 130 such that attachment pin 114 is aligned with bore 131 extending cylindrical end 115 into bore 131. Prong 153 is moved against shaft enlargement until end 113 thereof is brought into contact with shaft enlargement 130. Thereafter, prong 53 is aligned as desired and cap screw 133 is tightened within bore 132 to secure the position of prong 53. While not seen in FIG. 7, it will be understood that shaft enlargement 130 defines an additional bore parallel to bore 131 which receives attachment 104 of prong 52 (seen in FIG. 4) in an identical attachment to provide a properly positioned pair of arrow rest prongs. The purpose of FIG. 7 is to illustrate the universal attachment characteristics of the present invention arrow rest apparatus for use in a variety of attachment schemes.

What has been shown is a novel arrow rest for archery bow which utilizes a pair of multiply curved multiply angled arrow rest prongs to provide a substantially increased vane clearance for an arrow resting upon the prongs. The prongs are fabricated of molded Teflon portions which are secured to attachment pins during the molding process. The attachment pins formed on the arrow rest prongs are suited for use in a variety of different manufacturers arrow rest apparatus and are thus essentially universal in application.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in supporting an arrow shaft in an archery bow, an arrow rest comprising:

support means for attachment to an archery bow;

a pair of mirror image arrow rests prongs each having an attachment pin defining a cylindrical end and a head end and a prong portion molded upon said head end which defines an outwardly angled portion, an inwardly angled portion, and rest end curving downwardly and outwardly to form a curved crown portion; and retainer means supported upon said support means for holding said pair of arrow rest prongs in an upwardly angled generally symmetrical mirror-image relationship.

2. An arrow rest as set forth in claim 1 wherein said prong portions each define substantially circular cross-sections and are each generally tapered toward said rest end.

3. An arrow rest as set forth in claim 2 wherein said head ends of said attachment pins include a groove.

4. An arrow rest as set forth in claim 3 wherein said head end includes opposed cylindrical surfaces and opposed flat surfaces.

5. For use in supporting an arrow shaft proximate an archery bow, a pair of mirror image arrow rest prongs supported in a spaced apart relationship beneath the arrow shaft, each arrow rest prong comprising:

an attachment pin having an extending end and a head end; and a molded portion formed of a low-friction material and defining, an end portion molded upon and captivating said head end, an outwardly angled portion extending from said end portion, an inwardly angled portion extending from said outwardly angled portion, and a downwardly and outwardly curved rest end extending from said inwardly curved portion.

6. A pair of arrow rest prongs as set forth in claim 5 wherein each of said head ends of said attachment pins defines at least one flat portion.

7. A pair of arrow rest prongs as set forth in claim 5 wherein each of said head ends of said attachment pins defines a groove.

8. A method of manufacturing an arrow rest prong comprising the steps of:

providing an elongated generally cylindrical attachment pin;

forming a head end on said attachment pin; and molding a resilient prong portion upon said head end having, an end portion molded upon and captivating said head end, an outwardly angled portion extending from said end portion, an inwardly angled portion extending from said outwardly angled portion, and a downwardly and outwardly curved rest end extending from said inwardly curved portion.

9. The method of claim 8 wherein said step of forming a head end includes the step of forming at least one flat surface on said head end.

10. The method of claim 9 wherein said step of forming a head end includes the step of forming a groove proximate said head end.

11. The method of claim 8 wherein said step of forming a head end includes the step of forming a groove proximate said head end.

12. The method of claim 11 wherein said step of forming a head end includes the step of forming at least one flat surface on said head end.

* * * * *